US011167545B2

(12) United States Patent
Shibuya et al.

(10) Patent No.: US 11,167,545 B2
(45) Date of Patent: Nov. 9, 2021

(54) IMAGE FORMING METHOD AND IMAGE FORMING APPARATUS

(71) Applicant: Konica Minolta Inc., Tokyo (JP)

(72) Inventors: Satoru Shibuya, Chiryu (JP); Yusuke Nishisaka, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/926,243

(22) Filed: Jul. 10, 2020

(65) Prior Publication Data

US 2021/0053340 A1 Feb. 25, 2021

(30) Foreign Application Priority Data

Aug. 23, 2019 (JP) ..... JP2019-152893

(51) Int. Cl.

| | |
|---|---|
| ***B41J 2/005*** | (2006.01) |
| ***B41J 11/00*** | (2006.01) |
| *B41J 2/01* | (2006.01) |

(52) U.S. Cl.

CPC ..... *B41J 2/0057* (2013.01); *B41J 11/002* (2013.01); *B41J 2002/012* (2013.01)

(58) Field of Classification Search

CPC ... B41J 2/0057; B41J 11/002; B41J 2002/012

See application file for complete search history.

(56) References Cited

U.S. PATENT DOCUMENTS

2020/0130349 A1* 4/2020 Shibuya ..... B41J 2/01

FOREIGN PATENT DOCUMENTS

| | | |
|---|---|---|
| JP | 2009-226890 A | 10/2009 |
| JP | 2013-184453 A | 9/2013 |

* cited by examiner

*Primary Examiner* — Justin Seo

(74) *Attorney, Agent, or Firm* — Lucas & Mercanti, LLP

(57) ABSTRACT

An image forming method includes: providing an active light curable ink on a surface of an intermediate transfer body; irradiating the active light curable ink provided on the surface of the intermediate transfer body with first active light; and transferring the active light curable ink to a recording medium, wherein the wavelength of the first active light is a wavelength that causes the transmittance of the intermediate transfer body to be 70% or more, and causes the absorbance of the active light curable ink to be 0.01 or more.

13 Claims, 1 Drawing Sheet

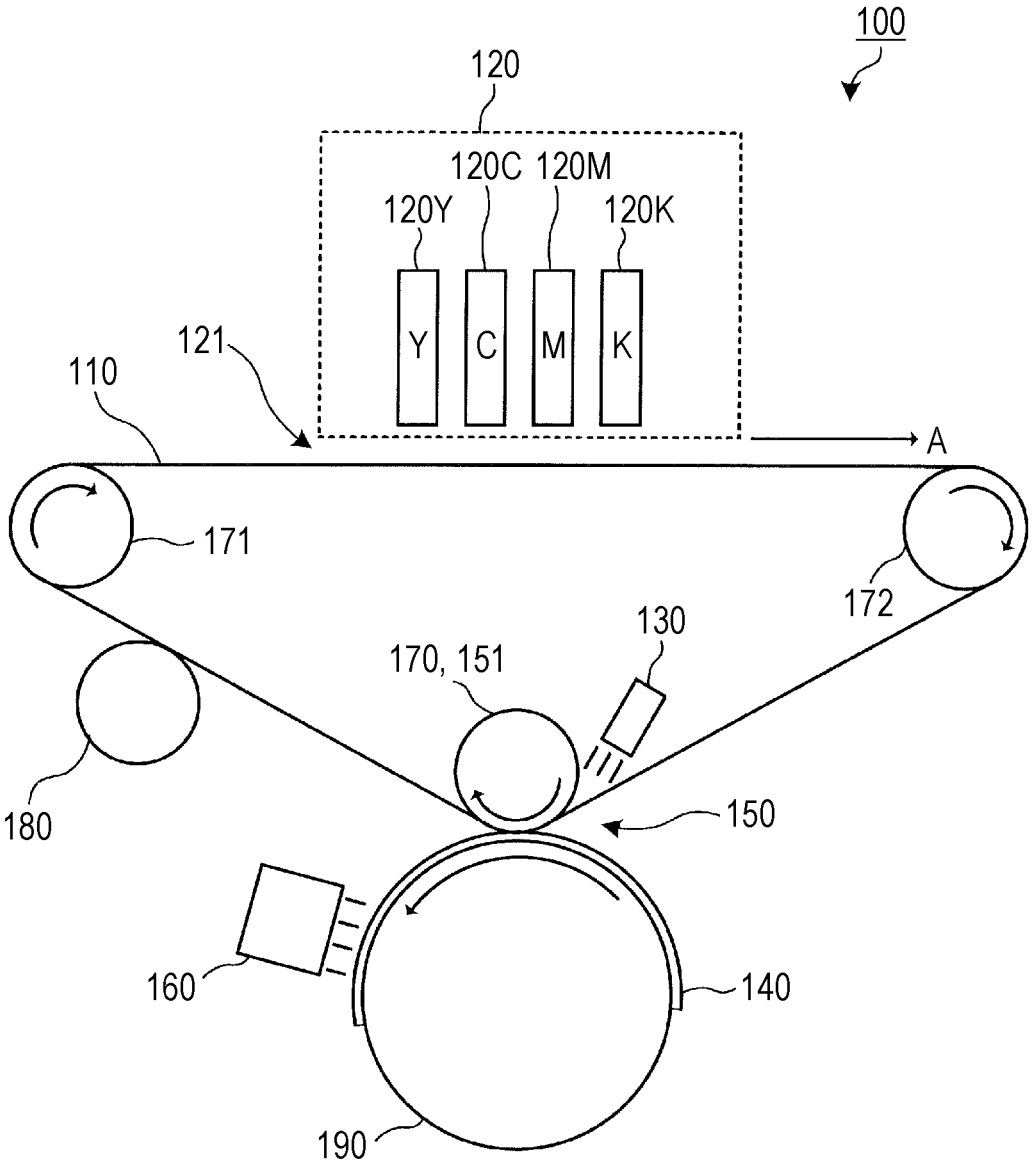
100
120
120C
120M
120Y
120K
Y
C
M
K
121
110
A
171
172
130
170, 151
180
150
160
140
190

IMAGE FORMING METHOD AND IMAGE FORMING APPARATUS

The entire disclosure of Japanese patent Application No. 2019-152893, filed on Aug. 23, 2019, is incorporated herein by reference in its entirety.

BACKGROUND

Technological Field

The present invention relates to an image forming method and an image forming apparatus.

Description of the Related Art

By using an inkjet method, images can be produced easily and at a low cost. Thus, the inkjet method is applied to various fields of printing including various printing, and special printing such as marking, hairline formation, and color filters. In particular, by using the inkjet method, digital printing can be performed without using printing blocks. Thus, the inkjet method is particularly suitable for applications for forming various images in small quantities.

When images are formed by the inkjet method on a recording medium that absorbs ink, such as paper, a part of ink that has been ejected from an inkjet head and landed on a recording medium permeates into the recording medium. Thus, if the amount of ink used for forming the image is reduced for cost reduction, the masking ratio in the image is decreased, and therefore unevenness tends to occur in the image. On the other hand, if the viscosity of ink is reduced in order to reduce permeation of the ink into the recording medium to facilitate spreading of the ink on the surface of the recording medium, the ink is easily blurred, and it is difficult to form high-resolution images.

In contrast, when an intermediate image is formed on the surface of an intermediate transfer body that is not easily permeated with ink, and thereafter the intermediate image is transferred to a recording medium, images with higher masking ratio can be formed even with a lower amount of ink, and a blur of the ink can be reduced. Accordingly, it is expected that high-resolution image formation at a lower cost becomes possible.

For realizing the low-cost and high-resolution image formation, there is a method of irradiating ink droplets that constitute an intermediate image formed on the surface of an intermediate transfer body with active light to increase the viscosity of the ink droplets. In addition, an image forming method including thickening of ink droplets while deterioration of an intermediate transfer body by active light is prevented has been studied.

For example, JP 2013-184453 A discloses a method including a step of providing a water-based ink on a layer to be cured formed on the surface of an intermediate transfer body, and a transfer step of transferring the layer to be cured to which the water-based ink has been provided from the intermediate transfer body to a recording medium, and further including, before the transfer step, a first ultraviolet ray irradiation step of irradiating the water-based ink which has been provided to the layer to be cured with ultraviolet rays to cure the water-based ink, and a second ultraviolet ray irradiation step of irradiating the layer to be cured with ultraviolet rays after the first ultraviolet ray irradiation step to cure the layer to be cured. In JP 2013-184453 A, it is said that the above-described image forming method can prevent a decrease in fixability of the layer to be cured to the recording medium by using ultraviolet rays having different wavelengths in the first ultraviolet ray irradiation step and the second ultraviolet ray irradiation to cure the water-based ink and the layer to be cured, respectively.

In addition, JP 2009-226890 A discloses a recording device having a curable solution layer forming means for forming a curable solution layer on an intermediate transfer body, a transfer means for transferring the curable solution layer to a recording medium, a first stimulation providing means that is disposed inside the intermediate transfer body for irradiating the curable solution layer with light including ultraviolet rays (wavelength range: 250 to 500 nm), and a second stimulation providing means that is disposed outside the intermediate transfer body for irradiating the curable solution layer transferred to the recording medium with light including ultraviolet rays (wavelength range: 250 to 500 nm). In JP 2009-226890 A, it is said that when the ratio of an integrated irradiation intensity of light having wavelengths within a curing wavelength range (310 to 370 nm) to an integrated irradiation intensity of the light including ultraviolet rays with which the curable solution layer is irradiated in the first stimulation providing means is larger than the ratio of an integrated irradiation intensity of light having wavelengths within a curing wavelength range (310 to 370 nm) to an integrated irradiation intensity of the light including ultraviolet rays with which the curable solution layer is irradiated in the second stimulation providing means, desired transferability and fixability to an image can be achieved, and deterioration of the intermediate transfer body can be prevented.

As in JP 2013-184453 A, when ink is irradiated with each of active rays having wavelengths that are different from each other before a transfer step and after the transfer step, transferability of the ink and fixability of the ink to a recording medium can be improved. However, it is sometimes impossible to achieve a desired durability of an intermediate transfer body. On the other hand, as in JP 2009-226890 A, when the integrated irradiation intensity of active light with which the intermediate transfer body is irradiated is reduced, deterioration of the intermediate transfer body can be prevented. However, it is sometimes impossible to achieve a desired transferability of ink and a desired fixability of the ink to a recording medium.

SUMMARY

An object of the present invention, which has been made under the above circumstances, is to provide an image forming method and an image forming apparatus which are capable of preventing deterioration of an intermediate transfer body, excellent in transferability and fixability, and capable of producing a high-resolution image.

To achieve the abovementioned object, according to an aspect of the present invention, an image forming method reflecting one aspect of the present invention comprises: providing an active light curable ink on a surface of an intermediate transfer body; irradiating the active light curable ink provided on the surface of the intermediate transfer body with first active light; and transferring the active light curable ink to a recording medium, wherein the wavelength of the first active light is a wavelength that causes the transmittance of the intermediate transfer body to be 70% or more, and causes the absorbance of the active light curable ink to be 0.01 or more.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 1 is a schematic view showing an illustrative configuration of an image forming apparatus according to an embodiment of the present invention.

DETAILED DESCRIPTION OF EMBODIMENTS

Hereinafter, one or more embodiments of the present invention will be described with reference to the drawings. However, the scope of the invention is not limited to the disclosed embodiments.

1. Image Forming Method

An image forming method according to an embodiment of the present invention includes: a step of providing an active light curable ink on a surface of an intermediate transfer body, a first active light irradiation step of irradiating the active light curable ink provided on the surface of the intermediate transfer body with first active light, and a step of transferring the active light curable ink to a recording medium. The above-described image forming method preferably further includes a second active light irradiation step of irradiating the active light curable ink transferred to the recording medium with second active light.

In the present embodiment, the transmittance of the above-described intermediate transfer body at a wavelength of the first active light is 70% or more. The absorbance of the above-described active light curable ink at a wavelength of the first active light is preferably 0.01 or more. Each of the steps will be described below.

1-1. Step of Providing Active Light Curable Ink

The step of providing an active light curable ink is a step of providing an active light curable ink on a surface of an intermediate transfer body to form an intermediate image.

[Active Light Curable Ink]

The active light curable ink according to the present embodiment contains an active light polymerizable compound, and at least two types of polymerization initiators including a first polymerization initiator and a second polymerization initiator, and is an ink which is cured by polymerization and crosslinking of the active light polymerizable compound by active light irradiation. In addition, the active light curable ink may further contain, if necessary, a gelling agent, a polymerization inhibitor, coloring materials such as a dye and a pigment, a dispersant for dispersing the pigment, a fixing resin for fixing the pigment to a substrate, a surfactant, a pH adjusting agent, a humectant, an ultraviolet absorber, or the like. The above-described composition may contain only one of the above-described optional ingredients (other ingredients), or may contain two or more.

(Active Light Polymerizable Compound)

The active light polymerizable compound is a compound which can be crosslinked or polymerized by active light irradiation. Examples of the active light include ultraviolet rays, X-rays, and γ-rays. Among the active light, ultraviolet rays are preferred. Examples of the active light polymerizable compound include a radical polymerizable compound and a cation polymerizable compound, or a mixture thereof. Among the above-described active light polymerizable compounds, a radical polymerizable compound is preferred. The active light polymerizable compound may be any of a monomer, a polymerizable oligomer, a prepolymer, and a mixture thereof.

The radical polymerizable compound refers to a compound having an ethylenic unsaturated double bond group in the molecule. The radical polymerizable compound may be a monofunctional or polyfunctional compound. Examples of the radical polymerizable compound include a (meth)acrylate, which is an unsaturated carboxylic acid ester compound. Herein, a "(meth)acrylate" refers to an acrylate or a methacrylate, a "(meth)acryloyl group" refers to an acryloyl group or a methacryloyl group, and "(meth)acryl" refers to acryl or methacryl.

Examples of the monofunctional (meth)acrylate include isoamyl (meth)acrylate, stearyl (meth)acrylate, lauryl (meth) acrylate, octyl (meth)acrylate, decyl (meth)acrylate, isomyristyl (meth)acrylate, isostearyl (meth)acrylate, 2-ethylhexyl-diglycol (meth)acrylate, 2-hydroxybutyl (meth) acrylate, 2-(meth)acryloyloxyethyl hexahydrophthalate, butoxyethyl (meth)acrylate, ethoxydiethylene glycol (meth) acrylate, methoxydiethylene glycol (meth)acrylate, methoxypolyethylene glycol (meth)acrylate, methoxypropylene glycol (meth)acrylate, phenoxyethyl (meth)acrylate, tetrahydrofurfuryl (meth)acrylate, isobornyl (meth)acrylate, 2-hydroxyethyl (meth)acrylate, 2-hydroxypropyl (meth) acrylate, 2-hydroxy-3-phenoxypropyl (meth)acrylate, 2-(meth)acryloyloxyethyl succinate, 2-(meth)acryloyloxyethyl phthalate, 2-(meth)acryloyloxyethyl-2-hydroxyethyl phthalate, and t-butylcyclohexyl (meth)acrylate.

Examples of the polyfunctional (meth)acrylate include bifunctional (meth)acrylates such as triethylene glycol di(meth)acrylate, tetraethylene glycol di(meth)acrylate, polyethylene glycol di(meth)acrylate, tripropylene glycol di(meth)acrylate, polypropylene glycol di(meth)acrylate, 1,4-butanediol di(meth)acrylate, 1,6-hexanediol di(meth) acrylate, 1,9-nonanediol di(meth)acrylate, neopentyl glycol di(meth)acrylate, dimethylol-tricyclodecane di(meth)acrylate, bisphenol A-PO adduct di(meth)acrylate, hydroxypivalic acid neopentyl glycol di(meth)acrylate, polytetramethylene glycol di(meth)acrylate, polyethylene glycol di acrylate, and tripropylene glycol diacrylate; trifunctional (meth)acrylates such as trimethylolpropane tri(meth)acrylate and pentaerythritol tri(meth)acrylate; and four or more functional (meth)acrylates such as pentaerythritol tetra(meth)acrylate, dipentaerythritol hexa(meth)acrylate, ditrimethylolpropane tetra(meth)acrylate, glycerinpropoxy tri (meth)acrylate, and pentaerythritolethoxy tetra(meth) acrylate; an oligomer having a (meth)acryloyl group such as a polyester acrylate oligomer; and modified substances thereof. Examples of the above-described modified substances include an ethylene oxide-modified (EO-modified) acrylate in which an ethylene oxide group is introduced, and a propylene oxide-modified (PO-modified) acrylate in which propylene oxide is introduced.

The cation polymerizable compound refers to a compound having a cation polymerizable group in the molecule. Examples of the cation polymerizable compound include an epoxy compound, a vinyl ether compound, and an oxetane compound.

Examples of the epoxy compound include aliphatic epoxy compounds including alicyclic epoxy resins such as 3,4-epoxycyclohexylmethyl-3',4'-epoxycyclohexane carboxylate, bis(3,4-epoxycyclohexylmethyl)adipate, vinylcyclohexene monoepoxide, ε-caprolactone modified 3,4-epoxycyclohexylmethyl 3',4'-epoxycyclohexane carboxylate, 1-methyl-4-(2-methyloxiranyl)-7-oxabicyclo[4,1,0]heptane, 2-(3,4-epoxycyclohexyl-5,5-spiro-3,4-epoxy)cyclohexanone-meth-dioxane, and bis(2,3-epoxycyclopentyl)ether, a diglycidyl ether of 1,4-butanediol, a diglycidyl ether of 1,6-hexanediol, a triglycidyl ether of glycerin, a triglycidyl ether of trimethylolpropan, a diglycidyl ether of polyethylene glycol, a diglycidyl ether of propylene glycol, and a polyglycidyl ether of polyether polyol, which is obtainable by adding one type or two or more types of alkylene oxides (e.g., ethylene oxide and propylene oxide) to an aliphatic polyvalent alcohol such as ethylene glycol, propylene glycol, and glycerin; and aromatic epoxy compounds including di- or poly-glycidyl ether of bisphenol A or an alkylene oxide adduct thereof, di- or poly-glycidyl ether of hydrogenated bisphenol A or an alkylene oxide adduct thereof, and a novolac-type epoxy resin.

Examples of the vinyl ether compound include monovinyl ether compounds including ethyl vinyl ether, n-butyl vinyl ether, isobutyl vinyl ether, octadecylvinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-o-propylene carbonate, dodecyl vinyl ether, diethylene glycol monovinyl ether, and octadecylvinyl ether; and di- or trivinyl ether compound including ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether, and trimethylolpropane trivinyl ether.

Examples of the oxetane compound include 3-hydroxymethyl-3-methyloxetane, 3-hydroxymethyl-3-ethyloxetane, 3-hydroxymethyl-3-propyloxetane, 3-hydroxymethyl-3-n-butyl oxetane, 3-hydroxymethyl-3-phenyloxetane, 3-hydroxymethyl-3-benzyloxetane, 3-hydroxyethyl-3-methyloxetane, 3-hydroxyethyl-3-ethyloxetane, 3-hydroxyethyl-3-propyloxetane, 3-hydroxyethyl-3-phenyloxetane, 3-hydroxypropyl-3-methyloxetane, 3-hydroxypropyl-3-ethyloxetane, 3-hydroxypropyl-3-propyloxetane, 3-hydroxypropyl-3-phenyloxetane, 3-hydroxybutyl-3-methyloxetane, 1,4-bis{[(3-ethyl-3-oxetanyl)methoxy]methyl}benzene, 3-ethyl-3-(2-ethylhexyloxymethyl)oxetane, and di[1-ethyl(3-oxetanyl)]methyl ether.

The content of the active light polymerizable compound is, for example, preferably 1.0 mass % or more and 97 mass % or less, and more preferably 30 mass % or more and 90 mass % or less with respect to the total mass of the active light curable ink.

(Polymerization Initiator)

The active light curable ink according to the present embodiment may contain a polymerization initiator. The polymerization initiator is not particularly limited as long as the initiator is capable of initiating polymerization of the active light polymerizable compound by active light irradiation. For example, when the active light curable ink contains a radical polymerizable compound, the polymerization initiator may be a photoradical initiator. When the active light curable ink contains a cation polymerizable compound, the polymerization initiator may be a photocationic initiator (photo-acid-generating agent).

Examples of the radical polymerization initiator include an intramolecular bond cleavage-type radical polymerization initiator and an intramolecular hydrogen abstraction-type radical polymerization initiator.

Examples of the intramolecular bond cleavage-type radical polymerization initiator include acetophenone-based initiators such as diethoxyacetophenone, 2-hydroxy-2-methyl-1-phenylpropan-1-one, benzyl dimethyl ketal, 1-(4-isopropylphenyl)-2-hydroxy-2-methylpropan-1-one, 4-(2-hydroxyethoxy)phenyl-(2-hydroxy-2-propyl)ketone, 1-hydroxycyclohexyl-phenylketone, 2-methyl-2-morpholino(4-methylthiophenyl)propan-1-one, and 2-benzyl-2-dimethylamino-1-(4-morpholinophenyl)-butanone; benzoins such as benzoin, benzoinmethyl ether, and benzoin isopropyl ether; acylphosphine oxide-based initiators including 2,4,6-trimethylbenzoin diphenyl phosphine oxide; and benzyl and methylphenyl glyoxy esters.

Examples of the intramolecular hydrogen abstraction-type radical polymerization initiator include benzophenone-based initiators including benzophenone, o-benzoylmethyl benzoate, 4-phenylbenzophenone, 4,4'-dichlorobenzophenone, hydroxybenzophenone, 4-benzoyl-4'-methyl-diphenylsulfide, acrylated benzophenone, 3,3',4,4'-tetra(t-butylperoxycarbonyl)benzophenone, and 3,3'-dimethyl-4-methoxybenzophenone; thioxanthene-based initiators including 2-isopropylthioxanthene, 2,4-dimethylthioxanthene, 2,4-diethylthioxanthene, and 2,4-dichlorothioxanthene; aminobenzophenone-based initiators including Michler's ketone and 4,4'-diethylaminobenzophenone; 10-butyl-2-chloroacridone; 2-ethylanthraquinone; 9,10-phenanthrenequinone; and camphorquinone.

Examples of the cationic polymerization initiator include photo-acid-generating agents. Examples of the photo-acid-generating agent include salts of aromatic onium compounds, which include diazonium, ammonium, iodonium, sulfonium, and phosphonium, with $B(C_6F_5)_4^-$, $PF_6^-$, $AsF_6^-$, $SbF_6^-$, and $CF_3SO_3^-$; a sulfonated substance which generates sulfonic acid; a halogenated substance which generates a halogenated hydrogen with light; and an iron-allene complex.

The active light curable ink according to the present embodiment preferably contains at least two or more types of radical polymerization initiators including a first polymerization initiator and a second polymerization initiator. The polymerization initiator generally has a relatively low absorbance of electromagnetic wave having a relatively long wavelength, and the absorbance becomes higher as the wavelength of the electromagnetic wave becomes shorter. When absorbance is continuously measured from the longer wavelength side to the shorter wavelength side, the first polymerization initiator preferably has an active light absorbance of 0.01 or more at wavelengths of 400 nm to 500 nm, more preferably at 400 nm to 450 nm, and still more preferably at 400 nm or more and less than 440 nm. The second polymerization initiator preferably has an active light absorbance of 0.01 or more at wavelengths of 330 nm to 460 nm, and more preferably at 370 nm or more and less than 410 nm. As the first polymerization initiator, "IRGACURE 819" (manufactured by BASF, "IRGACURE" is a registered trademark of the company), and "IRGACURE 369" (manufactured by BASF) are preferred. As the second polymerization initiator, "IRGACURE 379" (manufactured by BASF), "Darocur TPO" (manufactured by BASF, "Darocur" is a registered trademark of the company) are preferred. Each of the wavelengths at which the first polymerization initiator and the second polymerization initiator initiate reactions can be measured by using a spectrophotometer "UV-2550" (manufactured by SHIMADZU CORPORATION).

Since the active light curable ink contains the first polymerization initiator and the second polymerization initiator, which initiate reactions at different wavelengths of active light, required states of the active light curable ink can be achieved in both the first active light irradiation step and the second active light irradiation step. The required state of the active light curable ink in the first active light irradiation step refers to a state in which the active light curable ink is thickened to such an extent that the active light curable ink can maintain wettability. The required state of the active light curable ink in the second active light irradiation step refers to a state in which the active light curable ink is completely cured and fixed to a recording medium.

The first polymerization initiator preferably has an absorbance at a first active light wavelength (e.g., 400 nm to 500 nm) of 0.01 or more, more preferably 0.01 or more and less than 0.2, and still more preferably 0.1 or more and less than 0.2. In addition, the first polymerization initiator preferably has an absorbance at a second active light wavelength (e.g., 330 nm to 460 nm) of 0.2 or more.

The second polymerization initiator preferably has an absorbance at the first active light wavelength (e.g., 400 nm to 500 nm) of 0.01 or less. In addition, the second polymerization initiator preferably has an absorbance at the second active light wavelength (e.g., 330 nm to 460 nm) of 0.01 or more, and more preferably 0.2 or more. Herein, the term "absorbance" refers to a dimensionless quantity showing that how much the intensity of active light is reduced when the active light has passed through an active light curable ink.

The absorbances of the first polymerization initiator and the second polymerization initiator can be obtained as follows. The transmittance of 0.01 mass % solution of the polymerization initiator in acetonitrile is measured by using a spectrophotometer (e.g., "UV-2550" (manufactured by SHIMADZU CORPORATION), and then calculation is performed by substituting the obtained transmittance value (formula (1)) into the following formula (2).

$$\text{Transmittance } (\%\ T) = (I/I0) \times 100\% \quad (1)$$

$$\begin{aligned}\text{Absorbance } (A) &= -\log(\%\ T/100) \quad (2)\\ &= -\log(I/I0)\\ &= \log(I0/I)\end{aligned}$$

(I0: radiant emittance of input light, I: radiant emittance of transmitted light)

Each of the contents of the first polymerization initiator and the second polymerization initiator is not particularly limited as long as the active light curable ink is sufficiently cured by active light irradiation, and ejection properties of the active light curable ink are not damaged. For example, the content of the first polymerization initiator is preferably 0.1 mass % or more and 20.0 mass % or less, and more preferably 1.0 mass % or more and 12.0 mass % or less with respect to the total mass of the active light curable ink. When the content is within the above-described range, the active light curable ink is not excessively cured by irradiation with first active light in a first active light irradiation step (described below), and the active light curable ink can have an appropriate viscosity.

The content of the second polymerization initiator is preferably 0.1 mass % or more and 20.0 mass % or less, and more preferably 1.0 mass % or more and 12.0 mass % or less with respect to the total mass of the active light curable ink. In the present embodiment, the content, with respect to the total mass of the active light curable ink, of the second polymerization initiator which initiates reaction in the second active light irradiation step is preferably larger than the content of the first polymerization initiator which initiates reaction in the first active light irradiation step. The ratio of the content of the first polymerization initiator to the content of the second polymerization initiator is preferably 1:1.5 to 1:5, and more preferably 1:3. When the ratio is within the above-described range, the active light curable ink can be completely cured by irradiation with the second active light in the second active light irradiation step.

(Polymerization Inhibitor)

The above-described active light curable ink may contain a polymerization inhibitor.

Examples of the polymerization inhibitor include an (alkyl) phenol, hydroquinone, catechol, resorcin, p-methoxyphenol, t-butylcatechol, t-butylhydroquinone, pyrogallol, 1,1-picrylhydrazyl, phenothiazine, p-benzoquinone, nitrosobenzene, 2,5-di-t-butyl-p-benzoquinone, dithiobenzoyl disulfide, picric acid, cupferron, aluminum N-nitrosophenylhydroxylamine, tri-p-nitrophenylmethyl, N-(3-oxyanilino-1,3-dimethylbutylidene)aniline oxide, dibutylcresol, cyclohexanone oxime cresol, guaiacol, o-isopropylphenol, butylaldoxime, methyl ethyl ketoxime, and cyclohexanone oxime.

The content of the polymerization inhibitor can be 0.05 mass % or more and 0.2 mass % or less with respect to the total mass of the ink.

(Gelling Agent)

The above-described active light curable ink may contain a gelling agent.

Examples of the gelling agent include aliphatic ketone compounds such as dipentadecyl ketone, diheptadecyl ketone, dilignoceryl ketone, dibehenyl ketone, distearyl ketone, dieicosyl ketone, dipalmityl ketone, dimyristyl ketone, lauryl myristyl ketone, lauryl palmityl ketone, myristyl palmityl ketone, myristyl stearyl ketone, myristyl behenyl ketone, palmityl stearyl ketone, palmityl behenyl ketone, and stearyl behenyl ketone; aliphatic ester compounds such as cetyl palmitate, stearyl stearate, behenyl behenate, icosyl icosanoate, behenyl stearate, palmityl stearate, lauryl stearate, stearyl palmitate, myristyl myristate, cetyl myristate, octyldodecyl myristate, stearyl oleate, stearyl erucate, stearyl linoleate, behenyl oleate, and arachidyl linoleate; amide compounds such as N-lauroyl-L-glutamic acid dibutylamide and N-(2-ethylhexanoyl)-L-glutamic acid dibutylamide; dibenzylidene sorbitols such as 1,3:2,4-bis-O-benzylidene-D-glucitol; petroleum-based wax such as paraffin wax microcrystalline wax, and petrolatum; botanical wax such as candelilla wax, carnauba wax, rice wax, Japan wax, jojoba oil, jojoba solid wax, and jojoba ester; animal wax such as beeswax, lanoline, and spermaceti wax; mineral-based wax such as montan wax and hydrogenated wax; hydrogenated castor oil or a hydrogenated castor oil derivative; modified wax such as a montan wax derivative, a paraffin wax derivative, a microcrystalline wax derivative, or a polyethylene wax derivative; higher fatty acids such as behenic acid, arachidic acid, stearic acid, palmitic acid, myristic acid, lauric acid, oleic acid, and erucic acid; higher alcohols such as stearyl alcohol and behenyl alcohol; hydroxy stearic acids such as 12-hydroxy stearic acid; 12-hydroxystearic acid derivatives; fatty acid amides such as lauric acid amide, stearic acid amide, behenic acid amide, oleic acid amide, erucic acid amide, ricinoleic acid amide, and 12-hydroxystearic acid amide; N-substituted fatty acid amides such as N-stearylstearic acid amide and N-oleylpalmitic acid amide; special fatty acid amides such as N,N'-ethylene bis stearylamide, N,N'-ethylenebis-12-hydroxystearylamide, and N,N'-xylylene bisstearylamide; a higher amine such as dodecylamine, tetradecylamine, or octadecylamine; fatty acid ester compounds such as stearyl stearate, oleyl palmitate, glycerin fatty acid ester, sorbitan fatty acid ester, propylene glycol fatty acid ester, ethylene glycol fatty acid ester, and polyoxyethylene fatty acid ester; sucrose fatty acid esters such as sucrose stearate and sucrose palmitate; synthetic wax such as polyethylene wax and α-olefin maleic anhydride copolymer wax; polymer wax; dimer acids; and dimer diols. The above-described wax may be used alone, or in combination of two or more.

The content of the gelling agent is preferably 0.5 mass % or more and less than 10.0 mass % with respect to the total mass of the active light curable ink, more preferably 1.0 mass % or more and 10.0 mass % or less with respect to the total mass of the active light curable ink, and still more preferably 2.0 mass % or more and 7.0 mass % or less with respect to the total mass of the active light curable ink.

(Coloring Material)

The above-described active light curable ink may contain a coloring material. A coloring material includes a pigment and a dye. From the viewpoint of further improving dispersion stability of the active light curable ink and forming an image having a high weather resistance, the coloring material is preferably a pigment. Examples of the pigment include organic pigments and inorganic pigments. Examples of the dye include various oil-soluble dyes.

The pigment can be selected, according to the color of an image to be formed, from a red or magenta pigment, a yellow pigment, a green pigment, a blue or cyan pigment, and a black pigment which are listed in color index, for example.

The content of a pigment or a dye is preferably 0.1 mass % or more and 20.0 mass % or less, more preferably 0.4 mass % or more and 10.0 mass % or less with respect to the total mass of the ink. When the content of a pigment or a dye is 0.1 mass % or more with respect to the total mass of the ink, color development of an obtained image becomes sufficient. When the content of a pigment or a dye is 20.0 mass % or less with respect to the total mass of the ink, the ink does not become too viscous.

(Dispersant)

The above-described pigment may be dispersed in a dispersant. The dispersant is not particularly limited as long as the dispersant can sufficiently disperse the pigment. Examples of the dispersant include a hydroxyl group-containing carboxylic ester, a salt of long-chain polyaminoamide and macromolecular acid ester, a salt of a macromolecular polycarboxylic acid, a salt of long-chain polyaminoamide and polar acid ester, a macromolecular unsaturated acid ester, a macromolecular copolymer, modified polyurethane, modified polyacrylate, a polyether ester type anionic activator, a naphthalenesulfonate formaldehyde condensate, an aromatic sulfonate formaldehyde condensate, a polyoxyethylene alkylphosphate ester, polyoxyethylene nonylphenyl ether, and stearylamine acetate.

(Fixing Resin)

The active light curable ink may contain a fixing resin in order to further improve rubbing resistance and blocking resistance of a coating film.

Example of the fixing resin include a (meth)acrylic resin, an epoxy resin, a polysiloxane resin, a maleic acid resin, a vinyl resin, a polyamide resin, nitrocellulose, cellulose acetate, ethyl cellulose, an ethylene-vinyl acetate copolymer, a urethane resin, a polyester resin, and an alkyd resin.

The content of the fixing resin may be, for example, 1.0 mass % or more and 10.0 mass % or less with respect to the total mass of the active light polymerizable compound.

(Surfactant)

The active light curable ink may contain a surfactant.

The surfactant can regulate surface tension of an ink. Thus, wettability of the provided ink to a substrate can be regulated, and unification of adjacent droplets can be prevented.

Examples of the surfactant include a silicone-based surfactant, an acetylene glycol-based surfactant, and a fluorine-based surfactant having a perfluoroalkenyl group.

The content of the surfactant is preferably 0.001 mass % or more and 10 mass % or less, and more preferably 0.001 mass % or more and 1.0 mass % or less with respect to the total mass of the active light curable ink.

(Other Ingredients)

The active light curable ink may contain, in addition to the above-described ingredients, other ingredients such as polysaccharides, a viscosity adjusting agent, a specific resistance adjusting agent, a film forming agent, an ultraviolet absorber, an antioxidant, an anti-discoloration agent, an antifungal agent, and an antirust, if necessary.

(Physical Properties of Active Light Curable Ink)

The active light curable ink preferably has a viscosity at 40° C. of $1\times10^3$ mPa·s or more and less than $5\times10^4$ mPa·s, and more preferably $3\times10^3$ mPa·s or more and less than $1\times10^4$ mPa·s. When the viscosity at a temperature of an intermediate transfer body at the time when the ink is provided is $1\times10^3$ mPa·s or more, droplets of the active light curable ink provided on the intermediate transfer body are less spreadable, and the droplets are hardly united into one body. On the other hand, when the viscosity at a temperature of an intermediate transfer body at the time when the ink is provided is less than $5\times10^4$ mPa·s, the ink is favorably ejected from an inkjet head.

From the viewpoint of further improving the properties of ejection from an inkjet head, the active light curable ink has a viscosity at 80° C. of preferably 3 mPa·s or more and 20 mPa·s or less. When the viscosity at 80° C. is 3 mPa·s or more and 20 mPa·s or less, the active light curable composition hardly forms a gel when the composition is ejected from an inkjet head. Thus, the active light polymerizable compound can be more stably ejected. In addition, when the active light curable ink contains a gelling agent, from the viewpoint of achieving sufficient gelation of the ink when the ink has been landed and cooled to normal temperature, the active light curable ink preferably has a viscosity at 25° C. of 1000 mPa·s or more. When the viscosity at 25° C. is 1000 mPa·s or more, excessive spreading of the droplets provided on the intermediate transfer body hardly occurs, and the droplets are hardly united into one body.

The viscosity of the active light curable ink at 40° C. and the viscosity of the ink at 80° C. can be obtained by measuring a temperature change of dynamic viscoelasticity of the active light curable ink using a rheometer. For example, the viscosity of the active light curable ink at 40° C. and the viscosity of the ink at 80° C. are obtained as follows. The active light curable ink is heated to 100° C., and the ink is cooled to 20° C. under conditions at a shear rate of 11.7 (1/s) and a temperature dropping rate of 0.1° C./s while the viscosity is measured by a stress-controlled rheometer (manufactured by Anton Paar, Physica MCR301 (cone-plate diameter: 75 mm, cone angle: 1.0°)) to obtain a temperature change curve of viscosity. The viscosity at 40° C. and the viscosity at 80° C. are obtained by reading a viscosity at 40° C. and a viscosity at 80° C. from the temperature change curve of the viscosity, respectively.

The active light curable ink has an absorbance at a first active light wavelength (400 nm to 500 nm) of preferably 0.01 or more and less than 0.2, and an absorbance at a second active light wavelength (330 nm to 460 nm) of preferably 0.2 or more. The absorbance of the active light curable ink may be an absorbance as measured using the above-described formula (1) and formula (2), or may be an absorbance of a polymerization initiator contained in the active light curable ink as measured by the above-described method.

[Method for Preparing Active Light Curable Ink]

The above-described active light curable ink can be prepared by mixing the above described active light polymerizable compound, at least two types of polymerization initiators including the first polymerization initiator and the second polymerization initiator, a polymerization inhibitor, a coloring material, and an optional other ingredient with heating. The resulting mixture is preferably filtered by a specified filter. When an ink containing a pigment is prepared, it is preferred that a pigment dispersion containing a pigment and an active light polymerizable compound is prepared, and thereafter the pigment dispersion is mixed with other ingredients. The pigment dispersion may further contain a dispersant.

The pigment dispersion can be prepared by dispersing a pigment in an active light polymerizable compound. The pigment may be dispersed using, for example, a ball mill, a sand mill, attritor, a rolling mill, an agitator, a Henschel mixer, a colloid mill, an ultrasonic homogenizer, a Perl Mill, a wet-jet mill, and a paint shaker. In this case, dispersant may be added.

[Method for Providing Active Light Curable Ink]

The method for providing the above-described active light curable ink on a surface of the intermediate transfer body is not particularly limited, and publicly known methods such as spray coating, a dip method, screen printing, gravure printing, offset printing, and an inkjet method can be used. In the present embodiment, in a step of forming an intermediate image by providing an active light curable ink on the surface of an intermediate transfer body, an inkjet method in which the active light curable ink is ejected from an inkjet head and provided on the surface of the intermediate transfer body is preferred.

The inkjet head used in the inkjet method may be any of an on-demand type inkjet head and a continuous type inkjet head. Examples of the on-demand type inkjet head include electromechanical conversion type inkjet heads such as a single cavity type, a double cavity type, a bender type, a piston type, a share-mode type, and a shared wall type inkjet head, and electrothermal conversion type inkjet heads such as a thermal inkjet type and a bubble jet type inkjet head ("bubble jet" is a registered trademark of Canon Inc.).

The inkjet head may be any of a scan type inkjet head and a line type inkjet head.

To improve droplet ejection properties of the active light curable ink, it is preferred that the active light curable ink in an inkjet head is heated to 40 to 120° C., and then the heated active light curable ink is ejected.

When the active light curable ink contains a gelling agent, the temperature of the active light curable ink in an inkjet head is preferably regulated to a temperature that is higher than the gelation temperature of the active light curable ink by 10° C. or more and less than 40° C. When the temperature of the active light curable ink in an inkjet head is at least 10° C. higher than the gelation temperature, the active light curable ink does not form a gel in the inkjet head or a surface of a nozzle, and the active light curable ink can be favorably ejected. When the temperature of the active light curable ink in an inkjet head is less than a temperature that is 40° C. higher than the gelation temperature of the active light curable ink, thermal load of the inkjet head can be reduced. In particular, in an inkjet head using a piezoelectric element, performance of the inkjet head can be easily decreased by thermal load, and therefore it is particularly preferred that the temperature of the active light curable ink is regulated within the above-described range.

When the above-described active light curable ink contains a gelling agent, the active light curable ink provided on the surface of an intermediate transfer body experiences pinning caused by crystallization of the gelling agent. Accordingly, dots formed by provision of the active light curable ink become less wettable and less spreadable, and unification of the dots formed by landing of the active light curable ink on the intermediate transfer body can be prevented.

In this case, to improve the pinning properties of the active light curable ink, the surface temperature of the intermediate transfer body may be around, or equal to or less than the gelation temperature of the gelling agent.

(Intermediate Transfer Body)

The intermediate transfer body includes a base material layer including: a resin having a structural unit containing a benzene ring, such as aromatic polyimide (PI), aromatic polyamide imide (PAI), polyphenylenesulfide (PPS), aromatic polyether ether ketone (PEEK), aromatic polycarbonate, and aromatic polyether ketone; polyvinylidene fluoride; and a mixture or a copolymer thereof. The intermediate transfer body may have, in addition to the base material layer, on a side of the surface on which an ink is to be provided, one or both of: an elastic layer including rubber such as silicone rubber (SR), chloroprene rubber (CR), nitrile rubber (NBR), and epichlorohydrin rubber (ECO), an elastomer, and an elastic resin; and a front surface layer including a fluorocarbon resin such as polytetrafluoroethylene (PTFE), perfluoroalkoxy alkane (PFA), and polyvinylidene difluoride (PVDF), and an acryl resin.

Alternatively, the intermediate transfer body may be formed of: a resin film such as a polyethylene terephthalate (PET) film, a polyimide film, a 1,4-polycyclohexylenedimethylene terephthalate film, a polyethylene naphthalate (PEN) film, a polyphenylene sulfide film, a polystyrene (PS) film, a polypropylene (PP) film, a polysulfone film, an aramid film, a polycarbonate film, a polyvinyl alcohol film, a polyethylene (PE) film, a polyvinyl chloride film, a nylon film, a polyimide film, and an ionomer film; and a cellulose derivative such as cellophane and cellulose acetate.

The steps described hereinabove include providing an active light curable ink directly on a surface of an intermediate transfer body, but the method is not limited thereto. The method may include, before the step of providing the active light curable ink on the surface of the intermediate transfer body, a step of providing a precoat liquid on the surface of the intermediate transfer body.

(Precoat Liquid)

As a precoat liquid, liquid components such as water and a water-soluble organic solvent can be used. The precoat liquid may contain an adjusting agent for adjusting surface tension and viscosity.

Examples of the water-soluble organic solvent include glycol, polyalkylene glycol, and glycerin, or a polymer and a copolymer thereof. Examples of the adjusting agent include a surfactant and a hydrophilic polymer.

The precoat liquid is preferably provided on the entire surface of the intermediate transfer body using publicly known liquid application methods such as spray coating, spiral coating using a nozzle or a slit, dipping coating, and roll coater coating.

When the precoat liquid is provided on the entire surface of the intermediate transfer body before the active light curable ink is provided on a surface of the intermediate transfer body, the intermediate image is easily detached from the surface of the intermediate transfer body when transferred to a recording medium.

1-2. First Active Light Irradiation Step

The first active light irradiation step is a step of irradiating the active light curable ink provided on a surface of the intermediate transfer body with first active light. In the first active light irradiation step, by irradiating the intermediate transfer body with the first active light from the back surface side, the active light curable ink provided on the surface of the intermediate transfer body can be thickened such that the hardness on the back surface side is high and the hardness on the front surface side is low. Accordingly, in the active light curable ink, the composition is hardly collapsed by a pressure when the ink is transferred. Furthermore, the ink is sufficiently wettable to the recording medium when transferred. Thus, fixability of the ink to the recording medium tends to be increased.

The wavelength of the first active light is not particularly limited as long as the transmittance of the above-described intermediate transfer body is 70% or more and the absorbance of the active light curable ink is 0.01 or more. The wavelength of the first active light is preferably 400 nm to 500 nm, more preferably 400 nm to 450 nm, and still more preferably 400 nm or more and less than 440 nm.

By using active light that causes the transmittance of the intermediate transfer body to be 70% or more for irradiation in this step, even when the intermediate transfer body is irradiated with the active light from the back surface side, a sufficient amount of the active light can reach the back surface side of the intermediate image. Thus, the active light curable ink can be sufficiently thickened. In addition, when the transmittance of the intermediate transfer body is 70% or more, deterioration of the intermediate transfer body due to excessive absorption of the active light by the intermediate transfer body can be prevented. Accordingly, long-term use of the intermediate transfer body becomes possible. From the above-described viewpoint, in this step, irradiation with active light that causes the transmittance of the intermediate transfer body to be 85% or more is preferred. The transmittance of the intermediate transfer body with respect to the first active light can be measured by using, for example, a spectrophotometer "UV-2550" (manufactured by SHIMADZU CORPORATION).

The first active light irradiation step can be performed at any time between the time when the step of providing the active light curable ink on the surface of the intermediate transfer body is started and the time when a step of transferring the active light curable ink to a recording medium (described below) is completed. As long as the first active light irradiation step is performed within the above-described period of time, the first active light irradiation step may be performed while the active light curable ink is being provided, or the first active light irradiation step may be performed while the active light curable ink is being transferred.

Herein, the front surface of the intermediate transfer body refers to a surface on which the active light curable ink has been provided (in the transfer step, the surface that comes into contact with a recording medium), and the back surface of the intermediate transfer body refers to a surface on which the active light curable ink has not been provided (in the transfer step, a surface that does not come into contact with a recording medium).

In the present embodiment, since the transmittance of the above-described intermediate transfer body at a wavelength of the first active light is 70% or more, even when the intermediate transfer body is irradiated with the first active light from the back surface side, a sufficient amount of the active light is transmitted through the intermediate transfer body and reaches the active light curable ink. Accordingly, the active light curable ink provided on the surface of the intermediate transfer body is thickened such that the hardness on the back surface side, which is brought into contact with the intermediate transfer body and pressed, is higher, and the hardness on the front surface side, which is brought into contact with a recording medium, is lower. In addition, in the present embodiment, the absorbance of the active light curable ink at a wavelength of the first active light is 0.01 or more. Accordingly, it becomes possible to prevent the second polymerization initiator from initiating a reaction in the first active light irradiation step, and allow the second polymerization initiator to initiate the reaction in the second active light irradiation step. Thus, the active light curable ink can be sufficiently cured in the second active light irradiation step.

1-3. Step of Transferring Active Light Curable Ink

The step of transferring the active light curable ink is a step of transferring the active light curable ink thickened in the first active light irradiation step from the intermediate transfer body to the surface of the recording medium. The step may further include a step of pressing the active light curable ink formed on a surface of the above-described intermediate transfer body with a pressure member at the time when the ink is transferred to the recording medium. When an image is pressed as described above, the pressure member preferably has a temperature of 20° C. or more and 90° C. or less, and more preferably 20° C. or more and 80° C. or less. By making the temperature of the pressure member to be within the above-described range, even when the glass transition temperature (Tg) of the active light curable ink is higher than room temperature, transferability is not decreased and the active light curable ink can be transferred from the intermediate transfer body to the above-described recording medium. The irradiation with the first active light may be performed while the transfer step is being carried out.

1-4. Second Active Light Irradiation Step

The second active light irradiation step is a step of irradiating the active light curable ink transferred to the recording medium with second active light. The second active light preferably has a wavelength that is shorter than the wavelength of the first active light. The wavelength of the second active light is preferably 330 nm to 460 nm, and more preferably 370 nm or more and less than 410 nm.

In the second active light irradiation step, the second polymerization initiator, which is contained in the active light curable ink according to the present embodiment, initiates a reaction. When the second polymerization initiator initiates the reaction, the active light curable ink transferred to the recording medium can be completely cured (actual curing). Accordingly, fixability of the active light curable ink to the recording medium can be increased.

In the present embodiment, the wavelength of the first active light and the wavelength of the second active light are different from each other, and the second polymerization initiator has a lower absorbance at the wavelength of the first active light and a higher absorbance at the wavelength of the second active light. Accordingly, it becomes possible to prevent the second polymerization initiator from initiating a reaction in the first active light irradiation step, and allow the second polymerization initiator to initiate the reaction in the second active light irradiation step. Thus, the active light curable ink can be sufficiently cured in the second active light irradiation step.

2. Image Forming Apparatus

FIG. 1 is a schematic illustration showing an example of a configuration of an inkjet image forming apparatus 100 according to an embodiment of the present invention.

The image forming apparatus 100 comprises an ink provider 120 that provides an active light curable ink on a surface of an intermediate transfer body 110, a first active light irradiator 130 that irradiates the active light curable ink provided on the surface of the intermediate transfer body 110 with first active light, a transferor 150 that transfers the active light curable ink to a recording medium 140, and a second active light irradiator 160 that irradiates the active light curable ink transferred to the recording medium 140 with second active light. The image forming apparatus 100 further comprises support rollers 170, 171, and 172 that stretch and support the intermediate transfer body 110 having a shape of an endless belt, and a cleaner 180 that removes a residual portion of the active light curable ink that has not been transferred to the recording medium 140 and remained on the surface of the intermediate transfer body 110 from the surface of the intermediate transfer body 110.

The intermediate transfer body 110 is stretched and supported by the support rollers 170, 171, and 172, moves around, and transports an intermediate image formed on the surface of the intermediate transfer body 110 by an intermediate image former 121 to the transferor 150.

In the three support rollers 170, 171, and 172, at least one roller is a driving roller, and rotates the intermediate transfer body 110 in an A direction.

The intermediate transfer body 110 includes a base material layer including: a resin having a structural unit containing a benzene ring, such as aromatic polyimide (PI), aromatic polyamide imide (PAI), polyphenylenesulfide(PPS), aromatic polyether ether ketone (PEEK), aromatic polycarbonate, and aromatic polyether ketone; polyvinylidene fluoride; and a mixture or a copolymer thereof. The intermediate transfer body 110 may have, in addition to the base material layer, on a side of the surface on which an ink is to be landed, one or both of: an elastic layer including rubber such as silicone rubber (SR), chloroprene rubber (CR), nitrile rubber (NBR), and epichlorohydrin rubber(ECO), an elastomer, and an elastic resin; and a front surface layer including a fluorocarbon resin such as polytetrafluoroethylene (PTFE), perfluoroalkoxy alkane (PFA), and polyvinylidene difluoride (PVDF), and an acryl resin.

Alternatively, the intermediate transfer body 110 may be formed of: a resin film such as a polyethylene terephthalate (PET) film, a 1,4-polycyclohexylenedimethylene terephthalate film, a polyethylene naphthalate (PEN) film, a polyphenylene sulfide film, a polystyrene(PS) film, a polypropylene (PP) film, a polysulfone film, an aramid film, a polycarbonate film, a polyvinyl alcohol film, a polyethylene (PE) film, a polyvinyl chloride film, a nylon film, a polyimide film, and an ionomer film; and a cellulose derivative such as cellophane and cellulose acetate.

The intermediate transfer body 110 preferably has a transmittance at a wavelength of the first active light of 70% or more. The material of the intermediate transfer body 110 is not particularly limited as long as the material allows the transmittance at a wavelength of the first active light to be 70% or more.

In the intermediate transfer body 110, a portion stretched and supported between the support rollers 171 and 172, which are disposed, respectively, at the left and right vertex portions of the inverted triangle, is an ink landing surface on which the active light curable ink provided from the ink provider 120 lands. In the intermediate transfer body 110, the support roller 170, which is disposed at the lower vertex portion of the inverted triangle, is a pressure roller which presses the intermediate transfer body 110 against a transporting route 190 with a predetermined nip pressure, and functions as a pressure unit 151 that transfers the intermediate image, which is formed by provision of the active light curable ink ejected from the ink provider 120, to the recording medium 140.

The intermediate image former 121, which is also the ink provider 120, is an ink provider that forms an intermediate image by an inkjet method in the present embodiment, and has inkjet heads 120Y, 120M, 120C, and 120K that eject active light curable compositions (inkjet inks) having colors of yellow (Y), magenta (MI), cyan (C), black (K), respectively, from nozzles and provide the ejected active light curable compositions on the surface of the intermediate transfer body 110. The inkjet heads 120Y, 120M, 120C, and 120K each provide the above-described active light curable ink having the above-described color to positions suitable for an image to be formed on the surface of the intermediate transfer body 110 and form an intermediate image.

The first active light irradiator 130 irradiates the active light curable ink provided on the surface of the intermediate transfer body 110 with first active light. The first active light irradiator 130 can thicken the active light curable ink provided on the surface of the intermediate transfer body 110 by irradiation with the first active light from the back surface side of the intermediate transfer body 110. In the present embodiment, ultraviolet rays are preferably used as the first active light. The wavelength of the first active light is not particularly limited as long as the transmittance of the intermediate transfer body 110 is 70% or more and the absorbance of the active light curable ink is 0.01 or more. The wavelength of the first active light is preferably 400 nm to 500 nm, more preferably 400 nm to 450 nm, and still more preferably 400 nm or more and less than 440 nm.

The first active light irradiator 130 may be disposed at any position as long as the position allows the first active light irradiation to be performed between the time when the step of providing the active light curable ink on the surface of the intermediate transfer body 110 is started and the time when a step of transferring the active light curable ink to the recording medium 140 is completed. As long as the first active light irradiator 130 is disposed at a position which allows the irradiation within the above-described period of time, the first active light irradiator 130 may be disposed at a position which allows the active light curable ink to be irradiated with the first active light while the active light curable ink is being provided, or the first active light irradiator 130 may be disposed at a position which allows the active light curable ink to be irradiated with the first active light while the active light curable ink is being transferred.

By irradiating the intermediate transfer body 110 with active light that causes the transmittance of the intermediate transfer body 110 to be 70% or more using the first active light irradiator 130, even when the intermediate transfer body 110 is irradiated with the active light from the back surface side, a sufficient amount of the active light can reach the back surface side of the intermediate image. Thus, the active light curable ink can be sufficiently thickened. In addition, when the transmittance of the intermediate transfer body 110 is 70% or more, deterioration of the intermediate transfer body 110 due to excessive absorption of the active light by the intermediate transfer body 110 can be reduced. Accordingly, long-term use of the intermediate transfer body 110 becomes possible. From the above-described viewpoint, irradiation with active light that causes the transmittance of the intermediate transfer body 110 to be 85% or more using the first active light irradiator 130 is preferred. The transmittance of the intermediate transfer body 110 with respect to the first active light can be measured by using, for example, a spectrophotometer "UV-2550" (manufactured by SHIMADZU CORPORATION).

In the present embodiment, since the transmittance of the above-described intermediate transfer body 110 at a wavelength of the first active light is 70% or more, even when the intermediate transfer body 110 is irradiated with the first active light from the back surface side, a sufficient amount of the active light is transmitted through the intermediate transfer body 110 and reaches the active light curable ink. Accordingly, the active light curable ink provided on the surface of the intermediate transfer body 110 is thickened such that the hardness on the back surface side, which is brought into contact with the intermediate transfer body 110 and pressed, is higher, and the hardness on the front surface side, which is brought into contact with a recording medium, is lower. In addition, in the present embodiment, the absorbance of the active light curable ink at a wavelength of the first active light is 0.01 or more. Accordingly, it becomes possible to prevent the second polymerization initiator from initiating a reaction in the first active light irradiator 130, and allow the second polymerization initiator to initiate the reaction in the second active light irradiator 160. Thus, the active light curable ink is sufficiently cured in the second active light irradiator 160.

By performing the first active light irradiation from the first active light irradiator 130 between the ink provider 120 and the transferor 150, in the intermediate image formed on the surface of the intermediate transfer body 110, the active light curable ink is thickened such that the hardness of the active light curable ink on the back surface side, which is brought into contact with the intermediate transfer body 110 and pressed, is higher, and the hardness of the active light curable ink on the front surface side, which is brought into contact with the recording medium 140, is lower. Accordingly, in the intermediate image, the composition is hardly collapsed by a pressure when the intermediate image is transferred. Furthermore, the intermediate image is sufficiently wettable to the recording medium 140 when transferred. Thus, fixability of the intermediate image to the recording medium 140 tends to be increased.

The transferor 150 is a portion where the intermediate transfer body 110 and the transporting route 190 are closest to one another. The transferor 150 presses a portion of the surface of the transporting route 190 where the intermediate transfer body 110 is in contact with the transporting route 190 as the intermediate transfer body 110 is biased toward the transporting route 190 by the support rollers 170, 171, and 172. The active light curable ink, which is formed on the surface of the intermediate transfer body 110, delivered, and thickened by the first active light irradiation from the first active light irradiator 130, and the recording medium 140 that is disposed on the surface of the transporting route 190 and delivered are brought into contact with each other by the transferor 150, and the active light curable ink is pressed from the intermediate transfer body 110 toward the transporting route 190 by the support roller 170 to transfer the active light curable ink to the recording medium 140.

The second active light irradiator 160 irradiates the active light curable ink transferred to the recording medium 140 with second active light. The second active light preferably has a wavelength that is shorter than the wavelength of the first active light. The wavelength of the second active light is not particularly limited as long as the wavelength is shorter than the wavelength of the first active light. The wavelength of the second active light is preferably 330 nm to 460 nm, and more preferably 370 nm or more and less than 410 nm.

At the second active light irradiator 160, among the polymerization initiators contained in the active light curable ink according to the present embodiment, the second polymerization initiator initiates a reaction. When the second polymerization initiator initiates the reaction, the active light curable ink transferred to the recording medium 140 can be completely cured (actual curing). Accordingly, an intended high-resolution image can be formed.

The transporting route 190 is constituted by, for example, a metal drum, and transports the recording medium 140 to which an intermediate image is to be transferred. The transporting route 190 is disposed such that the surface of a part of the intermediate transfer body 110 is in contact with the transporting route 190. The above-described surface of the intermediate transfer body 110 that is in contact with the transporting route 190 is pressed by the support roller 170 to form the transferor 150. The transporting route 190 may have a claw (not illustrated) to which an end of the recording medium 140 is fixed. The transporting route 190 fixes an end of the recording medium 140 to the claw, rotates in a counterclockwise direction in FIG. 1, and thereby transports the recording medium 140 to a transfer nip.

The cleaner 180 is a cleaning roller such as a web roller or a sponge roller, and is in contact with the surface of the intermediate transfer body 110 at a portion on a downstream side of the transferor 150. In the cleaner 180, the cleaning roller is driven and rotated, and thus removes a composition residue (remaining coating material) which has not been transferred to the recording medium 140 at the transferor 150 and remains on the surface of the intermediate transfer body 110.

In the above description, an intermediate image is formed on the surface of the intermediate transfer body by an inkjet method. However the intermediate image forming method is not particularly limited, and publicly known methods such as spray coating, a dip method, screen printing, gravure printing, and offset printing can be used. Among these methods, in the inkjet method, since an image is formed by gathering dots of active light curable ink droplets, destruction of the active light curable ink droplets occurs more frequently. Thus, in the inkjet method, the effect of preventing destruction of the active light curable ink according to the image forming apparatus can be remarkably exhibited.

EXAMPLES

The present invention is specifically described with reference to examples below, but the present invention is not limited thereto.

Example 1

According to the following procedure, active light irradiation wavelengths in the first active light irradiation step and the second active light irradiation step were studied.

The irradiation wavelength in the first active light irradiation step was studied from the viewpoints of transmittance of the following intermediate transfer body and the transferability of the following active light curable ink.

1-1. Transmittance of Intermediate Transfer Body

Using a transparent polyimide film "TORMED TypeX" (manufactured by Industrial Summit Technology Corporation, "TORMED" is a registered trademark of the company) as an intermediate transfer body, active light irradiation wavelengths causing the transmittance of the transparent polyimide film to be 70% or more were determined. The above-described transmittance was measured by using a spectrophotometer "UV-2550" (manufactured by SHIMADZU CORPORATION). The active light wavelength causing the transmittance of the above-described transparent polyimide film to be 70% was 400 nm or more, and the active light wavelength causing the transmittance of the above-described transparent polyimide film to be 85% or more was 420 nm or more.

1-2. Transferability of Active Light Curable Ink

According to the following procedure, an active light curable ink 1 for measuring transferability was prepared.

(Preparation of Pigment Dispersion)

A stainless steel beaker was charged with 9.0 parts by mass of a pigment dispersant (AJISPER PB824, manufactured by Ajinomoto Fine-Techno Co., Inc., "AJISPER" is a registered trademark of AJINOMOTO CO., INC.), 70.0 parts by mass of an active light polymerizable compound (tripropylene glycol diacrylate), and 0.02 parts by mass of a polymerization inhibitor (Irgastab UV 10, manufactured by BASF, "Irgastab" is a registered trademark of the company), and heated and stirred for 1 hour on a hot plate at 65° C.

The resulting mixture was cooled to room temperature, and then 21.0 parts by mass of Pigment Red 122 (manufactured by Dainichiseika Color & Chemicals Mfg. Co., Ltd., Chromo Fine Red 6112JC) was added to the mixture. A glass bottle was charged with the resulting mixture together with 200 g of zirconia beads each having a diameter of 0.5 mm, hermetically sealed, and the contents were subjected to a dispersion treatment using a paint shaker for 8 hours. Thereafter, the zirconia beads were removed to afford a pigment dispersion.

(Preparation of Active Light Curable Ink 1)

A stainless steel beaker was charged with 5.0 mass % of a gelling agent "LUNAC BA" (behenic acid, manufactured by Kao Corporation, "LUNAC" is a registered trademark of the company), 29.9 mass % of an active light polymerizable compound (polyethylene glycol #400 diacrylate), 23.0 mass % of 6EO modified trimethylol propane triacrylate, 15.0 mass % of 4EO modified pentaerythritol tetraacrylate, 8.0 mass % of a first polymerization initiator "IRGACURE 819" (manufactured by BASF, "IRGACURE" is a registered trademark of BASF), 0.1 mass % of a surfactant "KF-352" (manufactured by Shin-Etsu Chemical Co., Ltd.), and 19.0 mass % of the pigment dispersion. Then, the contents were stirred for 1 hour while heated on a hot plate at 80° C. The resulting solution was filtered using a 3 μm Teflon (registered trademark) membrane filter (manufactured by ADVANTEC) with heating to obtain an ink 1.

The absorbance of the first polymerization initiator (IRGACURE 819) used for preparing the above-described active light curable ink 1 was measured. The absorbance was obtained as follows. First, the transmittance of the first polymerization initiator (IRGACURE 819) was measured by using a spectrophotometer "UV-2550" (manufactured by SHIMADZU CORPORATION), and then the value of the transmittance (formula (1)) is substituted into the following formula (2) to give the absorbance The first polymerization initiator (IRGACURE 819) used for the measurement was prepared using acetonitrile such that the concentration was 0.01 mass %. The absorbances at each of the first active light irradiation wavelengths are shown in Table 1.

$$\text{Transmittance } (\%\ T) = (I/I0) \times 100\% \quad (1)$$

$$\begin{aligned}\text{Absorbance } (A) &= -\log(\%\ T/100) \quad (2)\\ &= -\log(I/I0)\\ &= \log(I0/I)\end{aligned}$$

The active light curable ink 1 was provided on a surface of the intermediate transfer body (transparent polyimide film) by an inkjet method, thereafter the active light curable ink 1 provided from the back side of the intermediate transfer body was irradiated with first active light, and transferability of the active light curable ink 1 was measured. The results are shown in Table 1.

TABLE 1

| First active light irradiation wavelength | Amount of first active light irradiation | Transmittance of intermediate transfer body | Absorbance of first polymerization initiator | Transferability |
|---|---|---|---|---|
| 440 nm | 5.0 mW/cm$^2$ | 88% | 0.005 | X |
| 430 nm | 5.0 mW/cm$^2$ | 87% | 0.017 | ○ |
| 420 nm | 5.0 mW/cm$^2$ | 86% | 0.06 | ○ |
| 400 nm | 5.0 mW/cm$^2$ | 76% | 0.15 | ○ |
| 380 nm | 5.0 mW/cm$^2$ | 42% | 0.19 | X |
| 340 nm | 5.0 mW/cm$^2$ | 0% | 0.27 | X |

The above-described transferability was evaluated as follows.

(Evaluation Method)

The first active light irradiation was performed, and whether the active light curable ink was transferred from the intermediate transfer body to a recording medium (OK topcoat 128 g/m$^2$, manufactured by Oji Paper Co., Ltd.) or not was visually evaluated.

(Evaluation Criteria)

○: 90% or more of dots were transferred

Δ: 70% or more and less than 90% of dots were transferred x: ink was transferred in spots and not adequately transferred, or ink was cured and not transferred Thus, from the viewpoints of preventing deterioration of the intermediate transfer body and transferability, the first active light irradiation wavelength was defined to be within a range of 400 nm or more and less than 440 nm.

1-3. Determination of Irradiation Wavelength in Second Active Light Irradiation Step Using an active light curable ink irradiated with the first active light, fixability of the active light curable ink 1 after irradiation with second active light to a recording medium was measured. The results are shown in Table 2.

TABLE 2

| Second active light irradiation wavelength | Amount of second active light irradiation | Absorbance of first polymerization initiator | Fixability |
|---|---|---|---|
| 440 nm | 5.0 mW/cm$^2$ | 0.005 | X |
| 430 nm | 5.0 mW/cm$^2$ | 0.017 | X |
| 420 nm | 5.0 mW/cm$^2$ | 0.06 | Δ |
| 400 nm | 5.0 mW/cm$^2$ | 0.15 | Δ |
| 380 nm | 5.0 mW/cm$^2$ | 0.19 | ○ |
| 340 nm | 5.0 mW/cm$^2$ | 0.27 | ○ |

The above-described fixability was evaluated as follows.

(Evaluation Method)

After the first active light irradiation, irradiation with second active light was performed. Then, the surface of the active light curable ink fixed on the recording medium was rubbed with a finger wrapped with BEMCOT (manufactured by Asahi Kasei Corporation, "BEMCOT" is a registered trademark of the company), and stickiness of the surface was evaluated.

(Evaluation Criteria)

○: 90% or more of dots were fixed on the recording medium without detachment and dot deformation Δ: 70% or more and less than 90% of dots were fixed on the recording medium without detachment and dot deformation x: dots on the recording medium were detached, or dots were deformed and were not fixed on the recording medium 1-4. Evaluation In order to determine the combination of the first active light irradiation wavelength and the second active light irradiation wavelength, evaluations of image irregularities and durability of the intermediate transfer body were further performed under the following conditions. The results of the evaluations were shown in Table 3.

[Evaluation of Image Irregularities]

(Evaluation Method)

The active light curable ink 1 was introduced into an inkjet recording device having inkjet heads equipped with piezo-type inkjet nozzles. Square solid images (print density: 100%) each with 2 cm×2 cm and a resolution of 720×720 dpi were printed on an intermediate transfer body, the temperature of which was adjusted at 25° C. using a Peltier cooling unit. Roundness of dots of the resulting image was visually evaluated. In the following evaluation, it was decided that A or above was adequate for practical applications.

(Evaluation Criteria)

○: dots were round

Δ: dots were not round, but each dot maintained dot shape x: adjacent dots were united with each other, and each dot did not maintain dot shape

[Evaluation of Durability of Intermediate Transfer Body]

(Evaluation Method)

Using an ultraviolet ray irradiation device, an intermediate transfer body was irradiated with 16 W·hr/cm$^2$ of ultraviolet rays having a wavelength of 380 nm. The appearance of the intermediate transfer body after the irradiation and the appearance of the intermediate transfer body with no irradiation were compared by visual observation.

(Evaluation Criteria)

○: no discoloration

Δ: slightly discolored x: discolored

By using first active light having a wavelength within a range of 400 nm to 500 nm and second active light having a wavelength that is shorter than the wavelength of the first active light, favorable results were achieved with respect to image irregularities, transferability, and fixability. In addition, it was found that, by selecting and using active light wavelength that is capable of efficiently transmitting through an intermediate transfer body for the first active light irradiation, durability of the intermediate transfer body can be increased.

Example 2

According to the following procedure, active light irradiation wavelengths in the first active light irradiation step and the second active light irradiation step were studied.

The irradiation wavelength in the first active light irradiation step was studied from the viewpoints of transmittance of the following intermediate transfer body and the transferability of the following active light curable ink.

2-1. Transmittance of Intermediate Transfer Body

As an intermediate transfer body, a transparent polyimide film "TORMED TypeX" was used as in Example 1.

2-2. Transferability of Active Light Curable Ink

According to the following procedure, an active light curable ink 2 for evaluating transferability was prepared.

(Preparation of Pigment Dispersion)

A pigment dispersion was prepared as in the active light curable ink 1.

2-3. Preparation of Active Light Curable Ink 2

A stainless steel beaker was charged with 5.0 mass % of a gelling agent "LUNAC BA" (behenic acid, manufactured by Kao Corporation, "LUNAC" is a registered trademark of the company), 29.9 mass % of an active light polymerizable compound (polyethylene glycol #400 diacrylate), 23.0 mass % of 6EO modified trimethylol propane triacrylate, 15.0 mass % of 4EO modified pentaerythritol tetraacrylate, 2.0 mass % of a first polymerization initiator "IRGACURE 819" (manufactured by BASF), 6.0 mass % of a second polymerization initiator "IRGACURE 369", 0.1 mass % of a surfactant "KF-352" (manufactured by Shin-Etsu Chemical Co., Ltd.), and 19.0 mass % of the pigment dispersion. Then, the contents were stirred for 1 hour while heated on a hot plate at 80° C. The resulting solution was filtered using a 3 μm Teflon (registered trademark) membrane filter (manufactured by ADVANTEC) with heating to obtain an ink 2.

2-4. Determination of Irradiation Wavelength in First Active Light Irradiation Step Absorbances of the first polymerization initiator "IRGACURE 819" and the second polymerization initiator "IRGACURE 369", which were contained in the above-described active light curable ink 2, at the first active light irradiation wavelength were obtained as in Example 1. In addition, transferability of the active light curable ink 2 was evaluated as in Example 1. The results are shown in Table 4.

TABLE 3

| First active light irradiation wavelength | Second active light irradiation wavelength | Image irregularities | Transferability | Fixability | Durability of intermediate transfer body |
|---|---|---|---|---|---|
| 440 nm | 420 nm | X | X | X | ○ |
| 420 nm | 380 nm | Δ | ○ | Δ | ○ |
| 380 nm | 340 nm | ○ | X | ○ | X |

TABLE 4

| First active light irradiation wavelength | Amount of first active light irradiation | Transmittance of intermediate transfer body | Absorbance of first polymerization initiator | Absorbance of second polymerization initiator | Transferability |
|---|---|---|---|---|---|
| 430 nm | 5.0 mW/cm$^2$ | 87% | 0.017 | 0 | X |
| 410 nm | 5.0 mW/cm$^2$ | 83% | 0.10 | 0 | ○ |
| 390 nm | 5.0 mW/cm$^2$ | 63% | 0.17 | 0.005 | ○ |
| 370 nm | 5.0 mW/cm$^2$ | 14% | 0.22 | 0.24 | ○ |

The transferability can be ensured at irradiation wavelength of 410 nm or less. However, since it is desired that the second polymerization initiator initiates a reaction with second active light that contributed to fixability, it is desired that irradiation is performed at a wavelength at which the second polymerization initiator initiates almost no reaction (absorbance is 0.01 or less at the wavelength). Accordingly, since the irradiation wavelength in the first active light irradiation step can be selected within a range of 390 to 410 nm, 410 nm was selected as the irradiation wavelength.

2-5. Determination of Irradiation Wavelength in Second Active Light Irradiation Step The irradiation wavelength in the second active light irradiation step was determined by irradiating an active light curable ink that has been irradiated with first active light with second active light. Fixability of the active light curable ink 2 after irradiation with the second active light was measured as in Example 1. The results are shown in Table 5.

TABLE 5

| Second active light irradiation wavelength | Amount of second active light irradiation | Absorbance of second polymerization initiator | Fixability |
|---|---|---|---|
| 410 nm | 5.0 mW/cm$^2$ | 0.005 | X |
| 370 nm | 5.0 mW/cm$^2$ | 0.24 | ○ |
| 350 mn | 5.0 mW/cm$^2$ | 1.36 | ○ |
| 330 nm | 5.0 mW/cm$^2$ | 3.0 or more | ○ |

Since the fixability can be ensured at irradiation wavelength of 370 nm or less (absorbance of the second polymerization initiator is 0.2 or more), 370 nm was selected as the irradiation wavelength.

2-6. Evaluation

Evaluations with respect to image irregularities, transferability, fixability, and durability of the intermediate transfer body at the selected first active light irradiation wavelength and the second active light irradiation wavelength were performed. Each of the evaluations was performed as in Example 1. For comparison, evaluations at wavelengths around the above-described irradiation wavelengths were also performed. The results are shown in Table 6.

TABLE 6

| First active light irradiation wavelength | Second active light irradiation wavelength | Image irregularities | Transferability | Fixability | Durability of intermediate transfer body |
|---|---|---|---|---|---|
| 430 nm | 410 nm | X | X | X | ○ |
| 410 nm | 370 nm | ○ | ○ | ○ | ○ |
| 390 nm | 330 nm | ○ | X | ○ | X |

By using an active light curable ink containing a polymerization initiator that initiates a reaction in a first active light irradiation step and a polymerization initiator that initiates a reaction in a second active light irradiation step, favorable results of evaluations with respect to image irregularities, transferability, and fixability were obtained. In addition, it was found that, by selecting and using active light wavelength that is capable of efficiently transmitting through an intermediate transfer body for the first active light irradiation, durability of the intermediate transfer body can be increased. It is thought that, from the results of evaluating transferability, in the first active light irradiation step, the active light curable ink can be in a state in which the active light curable ink has such a viscosity that the composition is hardly collapsed by a pressure for transferring, and the active light curable ink is sufficiently wettable to the recording medium when transferred, and thus transferability is favorable. In addition, it is thought that, in the second active light irradiation step, the second polymerization initiator initiates a reaction to completely cure the active light curable ink that has been transferred to the recording medium, and thus fixability of the active light curable ink to the recording medium is favorable.

An image forming method according to an embodiment of the present invention is capable of preventing deterioration of an intermediate transfer body, is excellent in fixability and transferability, and is capable of providing a high-resolution image. Thus, it is expected that the present invention extends fields of application of intermediate transfer type image forming methods using an active light curable ink, and contributes to an advance and spread of the art in the field.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming method comprising:

providing an active light curable ink on a surface of an intermediate transfer body;

irradiating the active light curable ink provided on the surface of the intermediate transfer body with first active light; and transferring the active light curable ink to a recording medium, wherein the wavelength of the first active light is a wavelength that causes the transmittance of the intermediate transfer body to be 70% or more, and causes the absorbance of the active light curable ink to be 0.01 or more.

2. The image forming method according to claim 1, wherein the absorbance of the active light curable ink is an absorbance of a polymerization initiator contained in the active light curable ink.

3. The image forming method according to claim 1, wherein the wavelength of the first active light is a wavelength that causes the absorbance of the active light curable ink to be 0.01 or more and less than 0.2.

4. The image forming method according to claim 1, wherein the irradiating is performed between a time when providing the active light curable ink to the surface of the intermediate transfer body is started and a time when transferring the active light curable ink to the recording medium is completed.

5. The image forming method according to claim 1, wherein the wavelength of the first active light is 400 nm to 500 nm.

6. The image forming method according to claim 1, further comprising irradiating the active light curable ink transferred to the recording medium with second active light, wherein the second active light has a wavelength that is shorter than the wavelength of the first active light.

7. The image forming method according to claim 6, wherein the wavelength of the second active light is a wavelength that causes the absorbance of the active light curable ink to be 0.2 or more.

8. The image forming method according to claim 6, wherein the active light curable ink contains at least two types of polymerization initiators including a first polymerization initiator and a second polymerization initiator.

9. The image forming method according to claim 8, wherein the second polymerization initiator has an absorbance at a wavelength of the first active light of 0.01 or less, and an absorbance at a wavelength of the second active light of 0.01 or more.

10. The image forming method according to claim 8, wherein the content of the second polymerization initiator with respect to the total mass of the active light curable ink is larger than the content of the first polymerization initiator with respect to the total mass of the active light curable ink.

11. The image forming method according to claim 8, wherein the absorbance of the first polymerization initiator with respect to the first active light is 0.1 or more, and the absorbance of the second polymerization initiator with respect to the second active light is 0.2 or more.

12. The image forming method according to claim 1, wherein the active light curable ink is provided by an inkjet method.

13. An image forming apparatus comprising:

an intermediate transfer body;

an ink provider that provides an active light curable ink on a surface of the intermediate transfer body;

a first active light irradiator that irradiates the active light curable ink provided on the surface of the intermediate transfer body with first active light;

a transferor that transfers the active light curable ink to a recording medium; and a second active light irradiator that irradiates the active light curable ink transferred to the recording medium with second active light, wherein the first active light irradiator radiates active light having a wavelength that causes the transmittance of the intermediate transfer body to be 70% or more, and causes the absorbance of the active light curable ink to be 0.01 or more.

* * * * *